US009080812B2

(12) United States Patent
Dreossi et al.

(10) Patent No.: US 9,080,812 B2
(45) Date of Patent: Jul. 14, 2015

(54) ABSORPTION DRYING DEVICE FOR A DISHWASHER AND ASSOCIATED METHOD

(75) Inventors: Giuseppe Dreossi, Stockholm (SE); Bernd Krische, Saltsjo-Boo (SE)

(73) Assignee: Electrolux Home Products Corporation N.V., Brussels (BE)

( * ) Notice: Subject to any disclaimer, the term of this patent is extended or adjusted under 35 U.S.C. 154(b) by 277 days.

(21) Appl. No.: 13/699,228

(22) PCT Filed: May 10, 2011

(86) PCT No.: PCT/EP2011/057533

§ 371 (c)(1),
(2), (4) Date: Feb. 4, 2013

(87) PCT Pub. No.: WO2011/147683

PCT Pub. Date: Dec. 1, 2011

(65) Prior Publication Data

US 2013/0125411 A1 May 23, 2013

(30) Foreign Application Priority Data

May 24, 2010 (EP) ..... 10005383

(51) Int. Cl.
*F26B 21/08* (2006.01)
*A47L 15/48* (2006.01)

(52) U.S. Cl.
CPC ..... *F26B 21/08* (2013.01); *A47L 15/481* (2013.01)

(58) Field of Classification Search
CPC ..... F26B 3/00; F26B 21/00; F26B 21/08; A47L 15/00; A47L 15/48; A47L 15/46
USPC ..... 34/82, 86, 90, 353; 95/115, 126; 134/18, 105, 109; 96/144
See application file for complete search history.

(56) References Cited

U.S. PATENT DOCUMENTS 3,103,227 A * 9/1963 Long ..... 134/95.2
3,739,487 A * 6/1973 Clark ..... 34/77

(Continued)

FOREIGN PATENT DOCUMENTS

CN 200960107 Y 10/2007
CN 200987659 Y 12/2007

(Continued)

OTHER PUBLICATIONS

Derwent; "Drying machine—has dehumidifier consisting of hygroscopic board part of chamber wall;" dated Jul. 23, 1986; XP002303707.

(Continued)

*Primary Examiner* — Steve M Gravini
(74) *Attorney, Agent, or Firm* — Alston & Bird LLP

(57) ABSTRACT

A device (5), arranged for fluid communication with a washing chamber (2) of a dish washer (1), the device (5) comprising a duct (6) arranged to allow a flow of air (9) between the washing chamber (2) and the device (5), a drying material (10) arranged in a bed (11) wherein the back side of the bed (11) is provided adjacent a side of the duct (6), the bed (11) being arranged for a flow of air (9) adjacent and parallel to the front side of the bed (11), the drying material (10) being able to withdraw moisture from the air flowing adjacent and parallel to the front side of the bed (11) during a withdrawal step, and release moisture to the air at the front side of the bed (11) during a regeneration step, a heating element (13) for heating the drying material (10) during the regeneration step, and a fan (14), arranged to circulate the air between the device (5) and the washing chamber (2), thereby generating the flow of air (9).

21 Claims, 2 Drawing Sheets

(56) References Cited

U.S. PATENT DOCUMENTS

| | | | | |
|---|---|---|---|---|
| 5,555,640 | A * | 9/1996 | Ou | 34/202 |
| 8,734,592 | B2 * | 5/2014 | Jerg et al. | 134/25.2 |
| 8,858,727 | B2 * | 10/2014 | Jerg et al. | 134/56 D |
| 8,869,424 | B2 * | 10/2014 | Hermann et al. | 34/486 |
| 2001/0042557 | A1 * | 11/2001 | Moh | 134/10 |
| 2003/0221709 | A1 * | 12/2003 | Jung et al. | 134/18 |
| 2005/0150528 | A1 * | 7/2005 | Kim | 134/108 |
| 2006/0278257 | A1 * | 12/2006 | Jerg et al. | 134/56 D |
| 2007/0295360 | A1 * | 12/2007 | Jerg et al. | 134/10 |
| 2007/0295373 | A1 | 12/2007 | Jerg et al. | |
| 2008/0006308 | A1 | 1/2008 | Classen et al. | |
| 2008/0011329 | A1 * | 1/2008 | Classen et al. | 134/25.2 |
| 2008/0083433 | A1 | 4/2008 | Jerg et al. | |
| 2008/0127997 | A1 | 6/2008 | Jerg et al. | |
| 2008/0283099 | A1 * | 11/2008 | Peukert et al. | 134/99.1 |
| 2011/0048464 | A1 * | 3/2011 | Rieger et al. | 134/25.2 |
| 2011/0139196 | A1 * | 6/2011 | Bartos et al. | 134/115 R |
| 2011/0146718 | A1 * | 6/2011 | Heidel et al. | 134/18 |
| 2011/0186094 | A1 * | 8/2011 | Hong | 134/115 R |
| 2013/0125411 | A1 * | 5/2013 | Dreossi et al. | 34/474 |
| 2013/0146091 | A1 | 6/2013 | Dreossi et al. | |
| 2014/0007767 | A1 * | 1/2014 | Grunewald | 95/126 |
| 2014/0060597 | A1 * | 3/2014 | Welch | 134/58 D |

FOREIGN PATENT DOCUMENTS

| | | | |
|---|---|---|---|
| DE | 37 41 652 | | 6/1989 |
| DE | 103 03 53 774 | | 2/2005 |
| DE | 60 2005 004740 | | 2/2009 |
| EP | 1 674 030 | | 6/2006 |
| EP | 2 353 487 | A2 | 8/2011 |
| EP | 2389854 | A1 * | 11/2011 |
| JP | 61 162985 | | 7/1986 |
| WO | WO-2006/029953 | | 3/2006 |
| WO | WO-2007/043863 | | 4/2007 |
| WO | WO 2011147700 | A1 * | 12/2011 |

OTHER PUBLICATIONS

International Search Report for Application No. PCT/EP2011/057533, dated Nov. 2, 2011.

Office Action from Chinese Patent Application No. 201180025319.4, dated Jul. 1, 2014.

Extended European Search Report from European Application No. 10005384.2, dated Dec. 6, 2010.

European Search Report for Application No. EP 10 00 5383 dated Oct. 19, 2010.

Office Action for European Application No. 11 718 743.5 dated Aug. 18, 2014.

Written Opinion for International Application No. PCT/EP2011/057533 dated Nov. 8, 2011.

International Search Report for Application No. PCT/EP2011/057798 dated Jun. 21, 2011.

Written Opinion for International Application No. PCT/EP2011/057798 dated Jun. 21, 2011.

Office Action for U.S. Appl. No. 13/699,228 dated Nov. 6, 2014.

* cited by examiner

ABSORPTION DRYING DEVICE FOR A DISHWASHER AND ASSOCIATED METHOD

CROSS REFERENCE TO RELATED APPLICATIONS

This application is a national stage application filed under 35 U.S.C. 371 of International Application No. PCT/EP2011/057533, filed May 10, 2011, which claims priority from European Patent Application No. 10005383.4, filed May 24, 2010, each of which is incorporated by reference herein in its entirety.

FIELD OF THE INVENTION

The present invention relates to a device for the processing of air in a dishwasher.

BACKGROUND OF THE INVENTION

The operation of a conventional dishwasher generally comprises a washing program of processes performed sequentially, such as e.g. a "pre-wash" step followed by a "clean" wash step, an "intermediate" wash step, and a "clear" wash step, or the like.

Occasionally, the washing program further comprises a "drying" step, wherein goods positioned in the washing container of the dish washer such as e.g. cutlery, glasses, plates, and/or pottery are dried from the adhering water. Analogously, a "humidifying" step may be comprised in the program for applying humid air on the goods positioned in the washing container.

In the prior art, dishwashing machines and processes are shown with the aim to improve the operation of the washing cycle.

In patent document EP1674030, a drying device of a dish washing machine is disclosed, comprising a washing cabinet connected to a circuit for processing humid air. A fan is provided for circulating the air between an intake opening and an outlet opening, wherein the circuit contains a means of drying the air consisting of two desiccant layers arranged in parallel and a heating element arranged between the desiccant layers forming a sandwich.

However, there are problems related to this invention. The drying device of the dishwashing machine is not optimized regarding its size, resulting in a somewhat bulky device. This has the further consequence of a dishwashing machine wherein less space is provided for the washing cabinet such that the dishwashing machine becomes less efficient. Alternatively, the device results in that the dishwashing machine becomes bigger, making it more difficult to transport and more inconvenient to fit in the kitchen.

SUMMARY OF THE INVENTION

It is an object of the present invention to mitigate the above problem and to provide a device that provides an efficient use of the space of a dish washer of given outer dimensions.

This and other objects are achieved by providing a device having the features defined in the independent claim. Preferred embodiments are defined in the dependent claims.

According to the present invention, there is provided a device, arranged for fluid communication with a washing chamber of a dish washer, the device comprising a duct arranged to allow a flow of air to and from the washing chamber, a drying material arranged in a bed within the duct, the bed having a front side and a back side, wherein the back side of the bed is provided adjacent a side of the duct, the bed being arranged for a flow of air adjacent and parallel to the front side of the bed such that the air flow is in direct contact with the bed, the drying material being able to withdraw moisture from the air flowing adjacent and parallel to the front side of the bed during a withdrawal step when the device is in use, and release moisture to the air at the front side of the bed during a regeneration step when the device is in use, a heating element arranged between and adjacent to the back side of the bed and an outer side of the washing chamber, and arranged to heat the drying material during the regeneration step when the device is in use such that moisture is released from the drying material, and a fan, arranged to circulate the air to and from the washing chamber, thereby generating the flow of air.

Thus, the present invention is based on the idea of providing a device for the withdrawal and release of moisture which construction is flat, such that the device occupies only a limited space of the dish washer. The bed, wherein the drying material is arranged, is arranged for a flow of air adjacent and parallel to the front side of the bed. In other words, the air may pass alongside and in direct contact with the front surface of the bed.

Instead of having a deep bed, which requires that air has to pass through it, the intention of the present invention is to provide a flat device which function is to withdraw moisture of air flowing over it and release moisture to the air, in the respective steps. Consequently, the thin, compact device of the present invention has the effect of providing a more compact dish washer, or analogously, that more space within the dish washer is provided e.g. for the dish to be washed.

The device of the present invention is arranged for fluid communication with a washing chamber of a dish washer. By the term "fluid communication", it is here meant that a fluid such as e.g. air with varying amounts of moisture may pass between the device and the washing chamber, and vice versa, of the dish washer.

The device comprises a duct arranged to allow a flow of air to and from the washing chamber. The word "duct" should be construed as a passage, channel, or conduit through which air may flow.

Furthermore, the device comprises a drying material. This material may be any kind of material that can take up moisture, i.e. water, from air and then be regenerated by releasing the moisture back to air, depending on the conditions such as material temperature, moisture saturation of the air and/or of the material, to which the material is subjected. In other words, the material may be a dehydratable material, wherein the uptake and release of moisture is reversible, such that the material may act as an absorber and a desorber of moisture.

The drying material as such may be realized in the device in any shape, still being able to withdraw and to regenerate moisture. As examples, the material may be provided as chunks, pellets, flakes, powder or as a monolithic slab. Alternatively, the drying material could be made from a monolithic material in the shape of a plate.

The drying material is arranged in a bed within the duct, the bed having a front side and a back side wherein the back side of the bed is provided adjacent a side of the duct. Thus, within the duct, the bed is provided such that the back side of the bed is provided adjacent and in direct contact with a side of the duct. In other words, there is no passage of air at the back side of the bed.

The back side of the bed may be provided adjacent and in direct contact with a side of the duct, wherein the side of the duct may be any side of the duct. As an example, if the duct is provided adjacent the washing chamber, the back side of the bed may be provided on the side of the duct provided closest to the washing chamber, such that the back side of the bed faces the washing chamber. Alternatively, the back side of the bed may be provided on the side of the duct provided furthest from the washing chamber, such that the front side of the bed faces the washing chamber.

The bed is arranged for a flow of air adjacent and parallel to the front side of the bed. Thus, when the device is in use, the air flows adjacent and parallel to the front side of the bed, whereas no air flow passes the back side of the bed. By "parallel", it is here meant that the air flows substantially alongside the front side of the bed, or "over" the bed, but that the air flow also may come in contact with the drying material. Analogously, by "adjacent", it is meant that the air flows in an immediate vicinity of the bed.

Furthermore, the bed is arranged such that the air flow may be in direct contact with the bed. In other words, the air may flow so closely over the bed when the device is in use, such that the air comes into contact with the bed.

An advantage with the bed being arranged for a flow of air adjacent and parallel to the front side of the bed is that the air flows merely along the front side of the bed. Thus, there is no flow of air at the back side of the bed. This makes the device even thinner, as no extra space is needed for a flow of air at the back side of the bed.

The drying material may have the advantageous property of a high surface-area-to-weight ratio, i.e. that the structure of the drying material is such that the material provides a big contact area for the uptake of water. This has the advantage that the drying material may be provided even thinner within the bed.

The drying material is able to withdraw moisture from the air flowing adjacent and parallel to the front side of the bed during a withdrawal step when the device is in use. In this withdrawal step, air from the washing chamber of the dish washer flows through the duct, and over the bed, wherein the air from the washing chamber may be very humid. The moisture comprised in the air passing through the device may at least partially be withdrawn or bound by the drying material, such that the "drying" of the air thereby facilitates the drying of the goods comprised in the washing chamber. Hence, by the word "withdraw", it is here meant that the drying material may adsorb, absorb, or otherwise bind or hold the moisture (i.e. water) in the air flowing adjacent and parallel to the bed. As a result, the air within the washing chamber becomes dryer when the air that has passed parallel to the bed is reintroduced into the chamber.

Thus, the humidity of the air before passing the drying material is higher than the humidity of the air after passing the drying material, in the withdrawal step. Hence, in the withdrawal step, the drying material acts as a "dryer" of the air, and may bind some of the moisture of the passing air.

Furthermore, the flow of air adjacent and parallel to the front side of the bed during the withdrawal step is heated by the heat of adsorption. In other words, the humid air, before passing the drying material, has a lower temperature than the temperature of the dryer air after passing the drying material. This increase of temperature is advantageous as additional heating of the air that is to enter into the washing chamber may, possibly, not be necessary. Furthermore, the heated air may more easily take up moisture from the goods before reentering into the device.

Analogously, the drying material is able to release moisture to the air at to the front side of the bed during a regeneration step when the device is in use. Contrary to the withdrawal step, air from the washing chamber of the dish washer, before applying the regeneration step, may be relatively dry. Thus, the drying material may be at least partially regenerated by releasing the moisture (i.e. water), which is associated with the drying material, to the air. In other words, the drying material may release the moisture to the air at the front side of the bed, such that the air in the washing chamber becomes more humid.

In the regeneration step, the drying material is able to release moisture to the air during operation of the fan. In this case, the drying material is able to release moisture to the air passing adjacent and parallel to the front side of the bed. Also, the drying material is able to release moisture to the air at the front side of the bed when the fan is not operated, i.e. when no air passes the bed.

In the regeneration step and during operation of the fan, the humidity of the air after passing the drying material is higher than the humidity of the air before passing the drying material, in the regeneration step. Thus, the drying material may release the moisture or water which is bound in the material, to the passing air.

A common factor for the withdrawal step and the regeneration step is that moisture is withdrawn from and released to, respectively, air at the front side of the bed. Thus, as the withdrawal and release of moisture is provided for the air at the front side of the bed, the device saves space. In other words, there is no air flow at the back side of the bed which may take up more space of the device.

A heating element is arranged to heat the drying material during the regeneration step, when the device is in use. Thus, the heat from the heating element increases the temperature of the drying material to a relatively high temperature, thereby regenerating the material to release moisture to the air.

The term "heating element" may be construed as any heat-producing unit, cell, radiator, or the like, known to the man skilled in the art. As a further example, a thin-film heater could be a possible heating element.

During the regeneration step, the moisture is released from the drying material to the air, such that the humidified air is passed from the device to the washing chamber of the dish washer. Thus, the hot, humid air enters the washing chamber and thereby heats up the goods comprised therein such as e.g. glasses, cutlery, plates, and/or cups. This is advantageous, as the hot, humid air may e.g. loosen ingrained food, grime or stains on the goods.

The device further comprises a fan which is arranged to circulate the air to and from the washing chamber, thereby generating the flow of air. In other words, the air may be circulated from the washing chamber, to the device, back to the washing chamber, and so on in a closed loop air circulation system without exchange of air with the environment outside the dishwasher. Hereby is avoided that the environment and the user of the dishwasher are disturbed by hot and humid air.

In the withdrawal step, the fan circulates the air such that the goods comprised in the washing chamber dries, i.e. in the cycle generated by the fan, the drying material decreases the amount of humidity in the washing chamber. Analogously, in the regeneration step, the fan may circulate the air such that the goods comprised in the washing are heated and humidified by the hot, humid air from the drying material, i.e. in the cycle generated by the fan, the drying material increases the amount of humidity in the washing chamber.

During the regeneration step, the fan speed may be operated such that an air flow is generated and that moisture is released from the drying material to the passing flow of air. Alternatively, the fan may be periodically turned off during the regeneration step, i.e. that the fan is operated intermittently. However, even if the fan is turned off, the drying material may still regenerate such that moisture is released from the drying material to the air.

By the word "fan" it is in this context meant e.g. a propeller, a turbine, or a pumping device, such that an air flow is generated when the device is in use.

The positioning of the fan in the device may for example be directly upstream of the bed. As an example, the fan may be provided in the vicinity of the bed, over which bed air is blown when the device is in use. Alternatively, the fan may be so closely provided to the bed such that the bed and the fan may be provided as a compact unit, to save space in the dish washer. However, any other positioning of the fan in the device is feasible, wherein the fan still provides a flow of air.

According to an embodiment of the present invention, the heating element is arranged as part of the bed. As an example, the heating element may be in direct, thermal contact with the drying material. In other words, the heating element may be embedded in the material bed such that the heating may provide a direct, uniform heating of the drying material. This is advantageous regarding the energy consumption of the device, as the transmission of heat between the heating element and the drying material hereby is provided efficiently. Thus, the arrangement yields an improved heating such that any heat losses between the heating element and the drying material is minimized.

According to an embodiment of the present invention, the heating element is arranged in the duct, separate from the bed. Thus, during the regeneration step, the flow of air may be heated by the heating element. By the phrase "separate from the bed", it is here meant that the heating element is not part of the bed, i.e. the heating element is provided in a position separate from the bed. This embodiment may be advantageous for a more homogenous heating of the air, wherein the heat from the air may be passed to the drying material.

Furthermore, by providing the heating element in the duct, any service or replacement of the heating element may possibly be more easily conducted.

According to an embodiment of the present invention, the heating element forms part of the backside of the bed. By this embodiment, it is meant that heating element may be positioned as an outer part of the bed. As an example, the heating element may be provided immediately adjacent the backside of the bed. This may be advantageous considering any repair and/or exchange of the heating element, as the heating element may be easily removed from the device.

According to an embodiment of the present invention, the heating element is an electrical heating resistor in the form of a plate, a wire, a coil, or a loop. This embodiment is advantageous regarding several aspects. As an example, if the heating element is provided as part of the bed, it may in the form of a plate, a wire, a coil, a loop, a sheet or a film be provided in a close vicinity, immediately adjacent, or directly in contact with the drying material that is to be heated during the regeneration step. This increases the efficiency of the heating of the drying material and mitigates heat loss effects.

Furthermore, a heating element in form of a plate, a wire, a coil, or a loop arranged as part of the bed may be provided throughout the bed comprising the drying material, e.g. that a wire may be distributed within the bed such that a more uniform heating of the drying material is achieved.

Another advantage with the above mentioned forms of a heating element is that if the heating element forms part of the backside of the bed, the device may be even thinner. As an example, if the heating element is in the form of a film, sheet or a plate, the film, sheet or plate may be thin and/or which may efficiently transfer heat to the bed.

Furthermore, a plurality of heating elements comprised in the device may be feasible to yield a more desirable heating. As an example, the heating element may comprise several element of a kind, e.g. several wires, coils, loops, sheets, or the like. Alternatively, any combination of heating elements may be feasible, e.g. one or more wires, coils, loops, and/or sheets According to an embodiment of the present invention, the device is arranged within a side wall of the dish washer. The term "side wall" may here be construed as any of the walls defining the dish washer, or alternatively, a panel of the dish washer. As an example, in the case of a parallelepiped-shaped dish washer, the wall may be any of the four side-walls provided vertically, or the two top and bottom walls of the dish washer. This is advantageous considering that the device may be neatly positioned in a side wall, thereby providing a thin device for the dish washer. As a further example, the side wall wherein the device is arranged may be arranged may be a door or an access panel of the dish washer.

One advantage of arranging the device within a side wall or a panel of the dish washer is that the device hereby will not impede on already confined space within the dish washer. This may especially be the case for the bottom compartment of the dish washer, which often may have a limited space for housing equipment. Thus, the embodiment of arranging the device within a side wall provides more space for the washing chamber, and/or that the arrangement of the device provides a smaller and/or more supple dish washer.

According to an embodiment of the present invention, the bed is a flat, elongated bed with a thickness less than 2 cm, such as less than 1 cm. By the terms "flat" and "elongated", it is here meant that the bed is formed as a wide "slab". The base of the slab may be quadratic and wide, whereas the height may be small. As another example, the flat, elongated bed may be fitted within the device being arranged within a side wall of the dish washer such that the size of the bed is adapted to the size of the side wall. Here, the bed may be of any shape, e.g. quadratic, rectangular or round to adapt to the size of the side wall.

Thus, with this embodiment, the drying material comprised in the elongated bed is realized as a thin arrangement of the material, instead of an arrangement wherein the drying material is provided in a deeper bed.

According to an embodiment of the present invention, the bed has a length of about 20-50 cm, such as 33-37 cm, and a width of about 20-50 cm, such as 33-37 cm. The above mentioned dimensions of the bed further emphasizes a flat, substantially quadratic bed which may, for example, be provided in a side wall of the dish washer. By the mentioned size of the bed, the bed may provide a volume or amount of the drying material arranged therein to be approximately 0.8-1.5 liter. Heat leakage as an effect of a much higher surface area of the bed compared to a more compact bed may be addressed by e.g. a thin thermal insulation layer.

According to an embodiment of the present invention, the drying material comprises activated alumina. The activated alumina has a very high surface-area-to-weight ratio which makes it most suitable for withdrawal of moisture. The air moisture sticks to the alumina itself in between tiny passages in the material, as air passes parallel to the bed. The moisture becomes trapped so that the air is dried out as it passes parallel to the bed in the withdrawal step. This process is reversible, and in the regeneration step, the alumina is heated such that the moisture stored is released.

By "activated alumina", it is here meant $Al_2O_3$. However, any similar compound with similar properties of those described above for the activated alumina, are also feasible embodiments of a drying material. As an example, zeolite and/or silica may be used.

An advantage of the use of activated alumina is that the material may withdraw moisture and regenerate at a much lower temperature than other drying materials used in the prior art. As an example, the activated alumina in the regeneration step may be heated to a lower temperature, compared to the use of e.g. zeolite. Moreover, it tolerates contact with liquid water better than many other alternatives. Furthermore, as the material cost of activated alumina is less than that of zeolite, the activated alumina of the present invention does not only contribute to an easier and faster heating of the drying material, but also cheaper.

Furthermore, by the use of activated alumina as a drying material, the regeneration step may be performed quicker, as the regeneration temperature is reached faster.

According to an embodiment of the present invention, the drying material is arranged to be heated by the heating element in the regeneration step to a temperature of 75-250° C., such as 130-200° C., such as 150-180° C. Thus, the activated alumina may be heated by the heating element to 130-200° C., such as 150-180° C. for regeneration when the device is in use.

As a comparing example, the use of zeolite as a drying material may require a heating of the material to approximately 250° C. for a release of moisture from the material. Thus, by the embodiment of the present invention, the example further emphasizes the advantages of the use of activated alumina compared to e.g. zeolite regarding factors such as cost and efficiency.

Another advantage of the activated alumina is that the temperature increase of the passing air during withdrawal becomes lower with this material compared with e.g. zeolite. In other words, during the withdrawal step, when moisture is to be withdrawn from the flow of air adjacent and parallel to the bed, the reaction wherein the moisture condensates is less exothermic compared with zeolite. Thus, the temperature of the flow of air after the withdrawal step using activated alumina is lower than the temperature of the flow of air if zeolite is used. As high-temperature air passing into the washing chamber may deform and/or melt components such as plastic devices or the like, arranged in the washing chamber, the use of activated alumina may be preferred.

The heat which is generated by the exothermic reaction at the withdrawal step may be used to e.g. heat water for a later stage in the dish cycle.

Another advantage of using activated alumina is that the material is not sensitive to water, i.e. that water is not detrimental to the activated alumina. Therefore, at the regeneration step, it is not necessary to have an uninterrupted flow of air adjacent and parallel to the bed which transports the moisture from the drying material.

According to an embodiment of the present invention, the device further comprises a container at least partly enclosing the bed. The container may be formed such that the bed is protected from damage and/or wear. Furthermore, the container may keep the bed compact and shield the bed from e.g. the fan such that pieces or dust from the drying material do not enter into the fan.

The portion of the container facing the front side of the bed, i.e. parallel to the air passing through the duct, may consist of a permeable material or structure such as e.g. a net, a mesh or a grid of wire.

As an example, the container at least partly enclosing the bed is comprised in the device, wherein the device may be arranged within a side wall of the dish washer. In this example, a side wall of the dish washer may serve as a side of the container. In this case, the side wall of the container may be provided with a suitable extra layer or coating. An advantage of this is that the regeneration temperatures may be even lower.

As a further example, if the back side of the container is provided adjacent a side of the duct, the side of the duct adjacent the container may serve as a side of the container.

Furthermore, a flat, wide passage of air may be provided adjacent and parallel to the bed for a flow of air parallel to the front side of the bed. Thus, the container which at least partly encloses the bed may be flat, which consequently makes the device flat. As an example, the width of the container may be approximately 2 cm, such that the flat device thereby may be conveniently positioned e.g. in a side wall or a panel of the dish washer.

According to an embodiment of the present invention, the container comprises a heat resistant insulating material such as a mineral material, e.g. Mica or alumina. As another example, silica may be used. Alternatively, the heat resistant insulating material may be a high temperature polymer, e.g. polyimide. The heat resistant insulating material may further be electrically insulating, which provides several advantages. As an example, the heating of the bed may be performed more efficiently, as the electrical insulation of the container enables more direct heating options within the bed.

Furthermore, the heat resistant insulating material provides a container which, when the device is in use, does not become as hot as a container of a heat-conducting material such as e.g. metal. Thus, the container comprising the heat resistant insulating material forms a container that allows high temperatures within the container.

Furthermore, the heat resistant insulating material is heat resistant such that the material may withstand high temperatures without melting, or deforming. Examples of materials may be ceramics, glass, high temperature polymers or natural minerals that can be shaped into desirable forms.

According to an embodiment of the present invention, the mineral is a Mica mineral. By "Mica", it is here meant a compound which may be of the kind $(K, Na, Ca)_2(Al, Mg, Fe)_{4-6}(Si, Al)_8O_{20}(OH, F)_4$.

Mica is a desirable mineral for a container as comprised in this invention. As an example, the Mica mineral may be split into very thin slices while retaining thermal resistance, and further, it may be formed into sheets that are easily cut still having sufficient mechanical strength and good electrical insulating properties. Thus, the container comprising the Mica mineral may be thin, i.e. the walls of the container may be thin. This decreases the size of the container, and furthermore, the size of the device such that the dish washer may be made smaller, or analogously, that more space is available for the dish to be washed.

Furthermore, the Mica mineral has extremely low thermal conductivity, which makes the material especially suitable for the high-temperature conditions within the container during operation, as the material mitigates the conduction of heat to the exterior.

Furthermore, the Mica mineral is refractory enough to withstand temperatures as high as 1200° C. Thus, the resistance to heat of the Mica mineral is highly advantageous for the application in dish washers, or the like, wherein the high temperatures may be detrimental for other material used.

Furthermore, the Mica mineral is inexpensive, which further emphasizes the suitability of the mineral for the purpose of the invention.

A further advantage of the use of the Mica mineral is its low thermal expansion. Thus, in the high-temperature environment that may arise in the dishwasher during operation, a container comprising a Mica mineral may to a higher extent conserve its shape compared with, for example, any metallic-based container, having a higher thermal expansion. This may have the further advantage if the container in its turn is enclosed by e.g. a housing. As an example of this, it is suitable that the container and the housing may have approximately the same low thermal expansion. By this, any air gap between the container and the housing may be conserved even when the items are subjected to high temperatures during operation of the dish washer, such that the insulating properties of the device are maintained.

According to the present invention, there is provided a method of processing air in a dish washer, the dish washer comprising a washing chamber and a device, the device comprising a duct, a drying material arranged in a bed within the duct, the bed having a front side and a back side wherein the back side of the bed is provided adjacent a side of the duct, a heating element and a fan, the method comprising circulating the air between the washing chamber and the device such that a flow of air is generated, wherein the air flows adjacent and parallel to the front side of the bed allowing the air to contact the drying material of said bed, withdrawing moisture from the air flowing adjacent and parallel to the front side of the bed by means of the drying material, and regenerating the drying material by heating the bed by means of the heating element, allowing at least a part of the moisture to be released to the air at the front side of the bed.

The discussion above relating to the device is in applicable parts also relevant to the method. Reference is made to that discussion.

BRIEF DESCRIPTION OF THE DRAWINGS

These and other aspects of the present invention will now be described in more detail, with reference to the appended drawings, wherein.

DETAILED DESCRIPTION

In the following description, the present invention is described with reference to a device arranged for fluid communication with a washing chamber of a dish washer.

Figure 1:
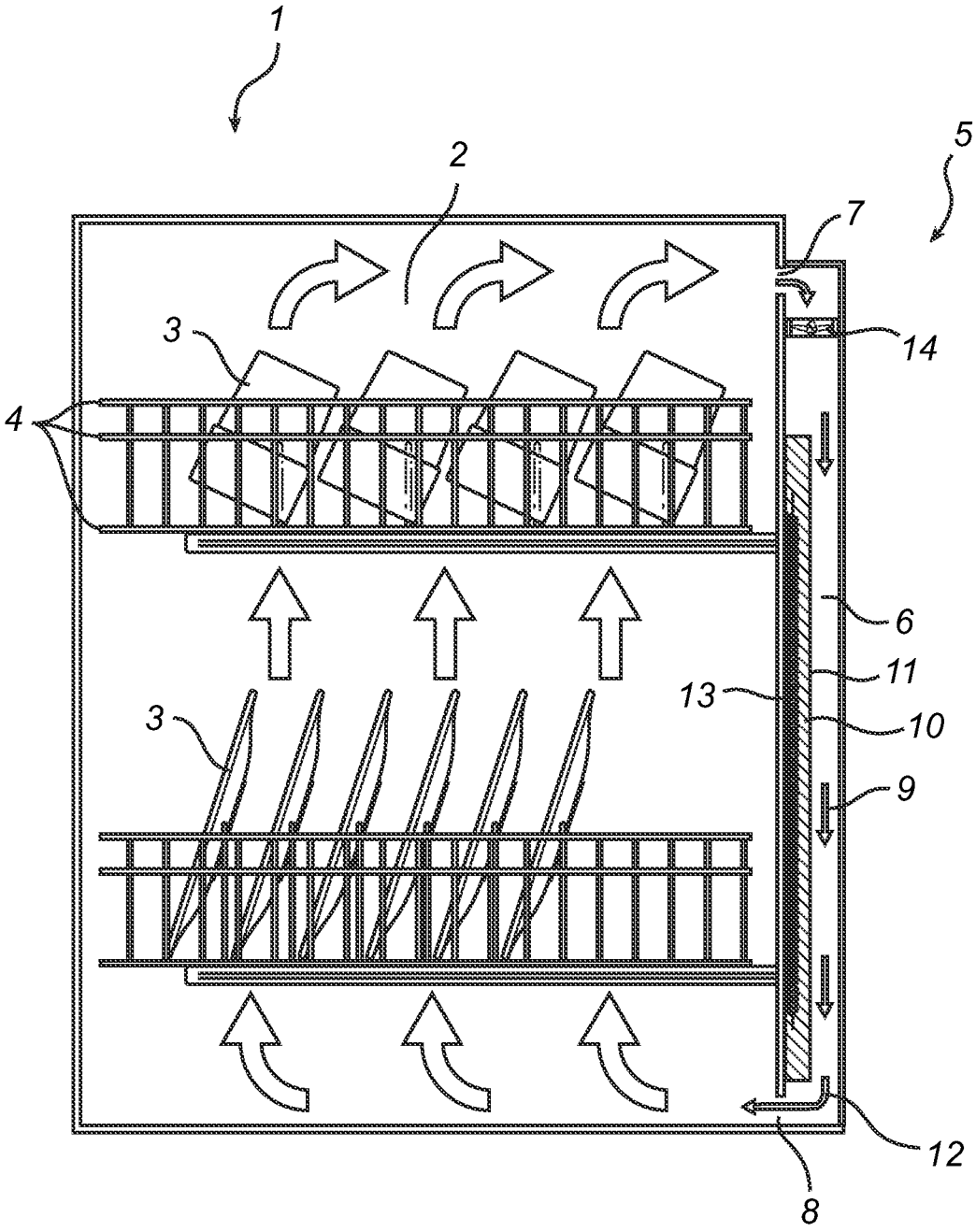
FIG. 1 is a schematic cross-sectional view of a dish washer comprising a device according to an embodiment of the present invention.

In FIG. 1, a schematic cross-sectional view of a dishwasher 1 is shown, wherein the dishwasher 1 comprises a washing chamber 2. Goods 3 that are to be washed such as e.g. glasses, cutlery, plates, and/or cups may be provided in dish trays 4 within the washing chamber 2.

Adjacent the washing chamber 2 is provided a device 5, wherein the device 5 is in fluid communication with the washing chamber 2. The device 5 comprises a duct 6 which is elongated and provided vertically in a close vicinity to the washing chamber 2. The duct 6 elongates from the top of the washing chamber 2, wherein an inlet 7 of the duct 6 is provided, to the bottom of the washing chamber 2. At the bottom of the duct 6, an outlet 8 of the duct 6 is provided into the washing chamber 2. Thus, the duct 6 of the device 5 is arranged for allowing a passage of air 9 between the washing chamber 2 and the device 5.

The device 5 may be provided within a side wall or a panel of the dish washer 1, as shown in FIG. 1. This embodiment provides more space for the washing chamber 2, and/or that the arrangement of the device 5 provides a smaller and/or more supple dish washer 1.

As shown in FIG. 1, the washing chamber 2 and the device 5 provides a circulation of air from the washing chamber 2, into the duct 6 of the device 5, back to the washing chamber 2, and so on, when the device 5 is in use. Hereby a closed air circulation loop is achieved, without exchange of air with the environment outside the dishwasher. Hence, there is no opening in the device 5, or in the dishwasher, allowing exchange of air with the environment outside the dishwasher, when in use.

A drying material 10 is arranged in a bed 11 within the duct 6, wherein the drying material 10 may be in the form of e.g. chunks, pellets, flakes, powder, or in the form of a monolithic slab. The bed 11 has a front side and a back side wherein the back side of the bed 11 is provided adjacent a side of the duct 6. Thus, the bed 11 is arranged for a flow of air 9 adjacent and parallel to the front side of the bed 11 such that the flow of air 9 is in direct contact with the bed 11.

The drying material 10 arranged in the bed 11 may withdraw moisture from the flow of air 9 adjacent and parallel to the front side of the bed 11 during a withdrawal step when the device 5 is in use. Thus, the drying material 10 may "dry" the flow of air 9 passing through the duct 6 to the washing chamber 2 such that the flow of air 12, after flowing adjacent and parallel to the drying material 10, may be relatively dry.

The flow of air 9 from the washing chamber 2 of the dishwasher 1 which flows adjacent and parallel to the front side of the bed 11 may be very humid. The moisture comprised in the flow of air 9 may at least partly be withdrawn by the drying material 10, i.e. the drying material 10 may at least partly adsorb, absorb, bind or hold the moisture (i.e. water) in the flow of air 9 adjacent and parallel to the front side of the bed 11 wherein the drying material 10 is arranged. Thus, the flow of air 12, i.e. the flow of air 9 after passing adjacent and parallel to the front side of the bed 11, is dried during the withdrawal step.

At the withdrawal step, the flow of air 12 is heated by the heat of condensation. Thus, the flow of air 12 which reenters the washing chamber 2 has a higher temperature than the flow of air 9 coming into the bed 11. The heated air 12 may take up moisture from the goods 3 before reentering into the device 5.

Analogously, the drying material 10 arranged in the bed 11 may release moisture to the air 9 at the front side of the bed 11 during a regeneration step when the device 5 is in use. Thus, the drying material 10 may regenerate such that the moisture (i.e. water), which is held in the drying material 10, may be released to the air 9. A heating element 13 is arranged at the back side of the bed 11, wherein the heating element 13 is arranged to heat the drying material 10 during the regeneration step when the device 5 is in use. By this, moisture may be released from the drying material 10.

The heating element 13 may generate a uniform heating of the drying material 10 during the regeneration step. Thus, the heat from the heating element 13 increases the temperature of the drying material 10 to a relatively high temperature. By this, the drying material 10 may release moisture, previously withdrawn from the air 9 by the drying material 10, to the air 9.

A fan 14 is provided at the top of the duct 6 in the vicinity of the bed 11, wherein the fan 14 is arranged to circulate the air 9 between the device 5 and the washing chamber 2. Thus, the fan 14 circulates the air 9 of the duct 6, adjacent and parallel to the front side of the bed 11 comprising the drying material 10, into the washing chamber 2, back to the duct 6, and so on.

In the regeneration step and during operation of the fan 14, the drying material 10 may release the moisture to the flow of air 9 passing adjacent and parallel to the bed 11. Thus, the flow of air 12, i.e. the flow of air 9 after passing the drying material 10, is humidified during the regeneration step.

Figure 2A:
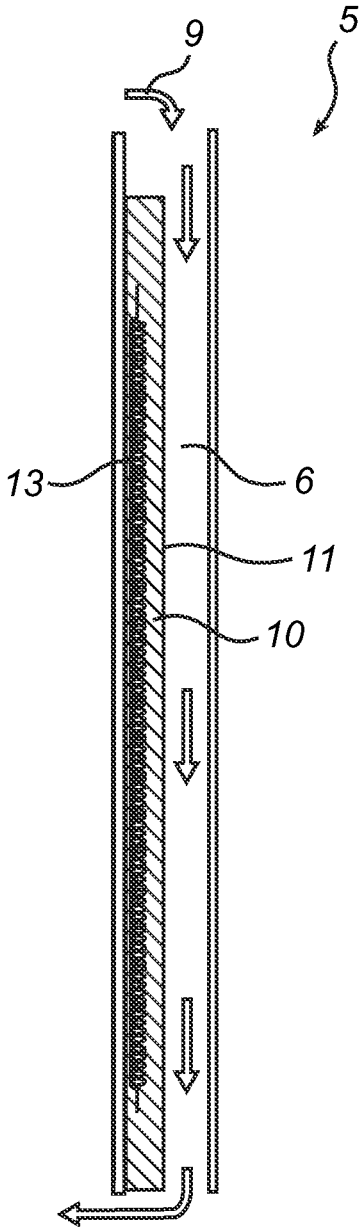
FIGS. 2*a*-2*b* are schematic views of the device according to embodiments of the present invention.

In FIG. 2*a*, a schematic view of the device 5 is shown, wherein the flow of air 9 from the washing chamber 2 of the dishwasher 1 flows adjacent and parallel to the front side of the bed 11 in the duct 6 during operation of the fan 14. In other words, the flow of air 9 passes over the bed 11, wherein the drying material 10 is arranged. The heating element 13 forms part of the back side of the bed 11, and elongates approximately along the entire length at the back side of the bed 11.

Figure 2B:
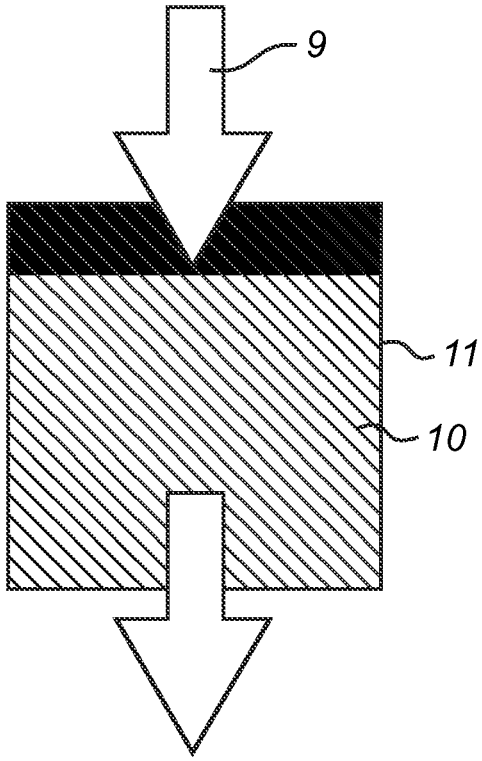

FIG. 2*b* shows a schematic view of the flow of air 9 during operation of the fan 14, wherein the flow of air 9 flows adjacent and parallel to the front side of the bed 11, in which bed 11 the drying material 10 is arranged. The bed 11 is depicted as a quadratic sheet or slab, having a relatively large surface, thereby providing a large surface for the withdrawal step and the regeneration step, respectively.

Even though the invention has been described with reference to specific exemplifying embodiments thereof, many different alterations, modifications and the like will become apparent for those skilled in the art. The described embodiments are therefore not intended to limit the scope of the invention, as defined by the appended claims.

For example, the relative sizes and the positions of the components of the dishwasher 1 and the device 5 could vary, as the figures are meant for a schematic illustration only. As an example, any size of the fan 14, the bed 11, the duct 6, or any other component may vary, as the purpose of the figures, to a higher extent than that of depicting relative sizes, is to describe the function of the dishwasher 1. More specifically, the duct 6 may be much thinner, the width of the bed 11 may be smaller, the fan 14 may be bigger, etc.

Furthermore, the positioning of the device 5 may be provided in a side wall under or over the washing chamber 2, or in any other position such that the device 5 is in fluid communication with the washing chamber 5. In the case that the device 5 is provided under or over the washing chamber 2, the flow of air 12 is substantially horizontal. In any case, the flow of air 12 may be vertical, diagonal, or horizontal, depending on the placement of the device 5.

As another example, the fan 14 may be provided anywhere in the device 5, still yielding an air flow 9 within the device 5.

Furthermore, the inlet 7 and the outlet 8 of the duct 6 may be provided at positions other than at the top and at the bottom, respectively, of the washing chamber 2. As an example, the inlet 7 may be provided at a lower position than that depicted in FIG. 1.

The invention claimed is:

1. A device, arranged for fluid communication with a washing chamber of a dish washer, the device comprising:

a duct arranged to allow a flow of air to and from the washing chamber, a drying material arranged in a bed within the duct, the bed having a front side and a back side, the bed being arranged for a flow of air adjacent and parallel to the front side of the bed such that the flow of air is in direct contact with the bed, wherein the back side of the bed is provided adjacent a side of the duct such that the flow of air does not pass over the back side of the bed, the drying material being able to withdraw moisture from the air flowing adjacent and parallel to the front side of the bed during a withdrawal step when the device is in use, and release moisture to the air at the front side of the bed during a regeneration step when the device is in use, a heating element arranged to heat the drying material during the regeneration step when the device is in use such that moisture is released from the drying material, and a fan, arranged to circulate the air to and from the washing chamber, thereby generating the flow of air.

2. The device as claimed in claim 1, wherein the heating element is arranged as part of the bed.

3. The device as claimed in claim 1, wherein the heating element is arranged in the duct, separate from the bed.

4. The device as claimed in claim 3, wherein the heating element forms part of the backside of the bed.

5. The device as claimed in claim 1, wherein the heating element is an electrical heating resistor in the form of a plate, a wire, a coil, a loop, a film, or a sheet.

6. The device as claimed in claim 1, wherein the device is arranged within a side wall of the dish washer.

7. The device as claimed in claim 1, wherein the bed is a flat, elongated bed with a thickness less than 2 cm.

8. The device as claimed in claim 7, wherein the bed has a length of about 20-50 cm and a width of about 20-50 cm.

9. The device as claimed in claim 1, wherein the drying material comprises activated alumina.

10. The device as claimed in claim 9, wherein the drying material is arranged to be heated by the heating element in the regeneration step to a temperature of 75-250° C.

11. The device as claimed in claim 1, further comprising a container at least partly enclosing the bed, wherein the container shares a wall with a side wall of a washing volume of the dishwasher.

12. The device as claimed in claim 11, wherein the container comprises a heat resistant insulating material.

13. The device according to claim 1, wherein no exchange of air with the environment outside the dishwasher is allowed in use.

14. A method of processing air in a dish washer, the dish washer comprising a washing chamber and a device, the device comprising a duct, a drying material arranged in a bed within the duct, the bed having a front side and a back side, a heating element and a fan, the method comprising:

circulating the air between the washing chamber and the device such that a flow of air is generated, wherein the air flows adjacent and parallel to the front side of the bed allowing the air to contact the drying material of said bed, wherein the back side of the bed is provided adjacent a side of the duct such that the flow of air does not pass over the back side of the bed;

withdrawing moisture from the air flowing adjacent and parallel to the front side of the bed by means of the drying material; and regenerating the drying material by heating the bed by means of the heating element, allowing at least a part of the moisture to be released to the air at the front side of the bed.

15. The method according to claim 13, wherein the flow of air is in the form of a closed air circulation loop, without exchange of air with the environment outside the dish washer.

16. The device as claimed in claim 1, wherein the bed is a flat, elongated bed with a thickness less than 1 cm.

17. The device as claimed in claim 7, wherein the bed has a length of about 33-37 cm, and a width of about 33-37 cm.

18. The device as claimed in claim 9, wherein the drying material is arranged to be heated by the heating element in the regeneration step to a temperature of 130-200° C.

19. The device as claimed in claim 9, wherein the drying material is arranged to be heated by the heating element in the regeneration step to a temperature of 150-180° C.

20. The device as claimed in claim 12, wherein the heat resistant insulating material comprises a mineral material.

21. The device as claimed in claim 20, wherein the mineral material is Mica or alumina.

* * * * *